US005282504A

United States Patent [19]

Anderson et al.

[11] Patent Number: 5,282,504

[45] Date of Patent: Feb. 1, 1994

[54] VENETIAN BLIND ASSEMBLY FOR A GLAZED DOOR

[75] Inventors: Richard N. Anderson, Whitesville; James E. Anderson; Eugene W. Thompson, both of Owensboro, all of Ky.

[73] Assignee: Hunter Douglas Inc., Upper Saddle River, N.J.

[21] Appl. No.: 864,761

[22] Filed: Apr. 7, 1992

[51] Int. Cl.[5] ..... E06B 3/32

[52] U.S. Cl. ..... 160/107; 49/64

[58] Field of Search ..... 160/107, 369, 371; 52/202; 49/64, 51

[56] References Cited

U.S. PATENT DOCUMENTS

| | | | |
|---|---|---|---|
| 2,266,973 | 12/1941 | Horton | 52/202 |
| 2,725,606 | 12/1955 | Persson | 160/107 X |
| 3,170,507 | 2/1965 | Kleinknecht | 160/369 |
| 3,175,603 | 3/1965 | Tonnon | 160/107 |
| 3,318,360 | 5/1967 | Persson | 160/107 |
| 3,704,563 | 12/1972 | Waller | 160/369 X |
| 4,127,156 | 11/1978 | Brandt | 160/369 X |
| 4,369,828 | 1/1983 | Tatro | 160/107 |
| 4,423,574 | 1/1984 | Pierre | 52/202 |
| 4,454,691 | 6/1984 | Mitchell | 160/107 X |
| 4,581,865 | 4/1986 | Miller | 52/202 |
| 4,611,648 | 9/1986 | Anderson | 160/107 |
| 5,000,242 | 3/1991 | Coddens | 160/107 |

*Primary Examiner*—David M. Purol

*Attorney, Agent, or Firm*—Gary M. Polumbus

[57] ABSTRACT

A venetian blind assembly is described, for use in a glazed door having a rectangular window insert mounted therein and forming a primary glazing. In the improved assembly a rectangular frame is provided with a secondary glazing mounted within the rectangular frame, and a venetian blind mounted completely within the frame so as to be between the primary and secondary glazings when the assembly is secured to the door. Holding clips engage the exterior of the rectangular frame and are held in place by screws which are engaged in holes used for the securing of the rectangular window frame insert into the main door body of the door. Alternatively, an additional frame may be secured to the door around the window insert of the door and the double glazed unit with the venetian blind therein may be held to this additional frame by means of snap-on clips.

5 Claims, 4 Drawing Sheets

VENETIAN BLIND ASSEMBLY FOR A GLAZED DOOR

BACKGROUND OF THE INVENTION

1. Field of the Invention

The present invention relates to venetian blind assemblies for glazed doors. More particularly, the present invention relates to venetian blind assemblies and secondary glazing for glazed doors.

2. Description of the Prior Art

Very often hinged doors to buildings have a window formed therein which is either a half-light (in the upper half of the door) or a full-light extending over the majority of the area of the door. It has been traditional to cover these glass lights with some form of window covering to ensure privacy and for decorative reasons.

A disadvantage of any window covering on such an application is they are liable to more damage than the coverings for windows in the wall of building, firstly because of their proximity to humans passing through the door as well as the opening and closing action of the door itself. While it has been thought desirable instead of having a conventional curtain or draw blind, to have a venetian blind, problems have been found when fitting a venetian blind over the "window" in a glazed door.

Not only are such blinds subjected to considerable abuse and damage due to the door opening and shutting, particularly when the door slams in the wind, but also, because people pass in close proximity to the blind itself, damage to the blind occurs and such damage and dirt appearing on the blind are readily visible.

OBJECTS OF THE INVENTION

The principal object of the present invention is to provide an improved venetian blind assembly for a glazed door.

SUMMARY OF THE INVENTION

In accordance with the foregoing objects, the present invention is embodied in an improved venetian blind assembly for a door having a primary glazing. The improved assembly is formed by a secondary glazing unit with a venetian blind positioned to the side of the secondary glazing unit which will face the primary door glazing, thus creating an installation of a venetian blind unit which is positioned between two glazing elements in the installed condition to provide an easy means for mounting such a unit on a glazed door.

Many glazed doors comprise a main door body, a rectangular window opening in said main door body, and a rectangular window insert fitting into the window opening, the window insert including a primary glazing. On some doors, a plurality of screw holes are provided in the door at spaced locations around the window opening, and a plurality of screws engaged in the screw holes to affix the window insert to the main door body. In other doors, the glazing is mounted within the opening and held therein by strips of molding.

The present invention provides, for use with such doors, a venetian blind assembly having:

a. a rectangular frame adapted to be secured on the exterior surface of the door;

b. a secondary glazing sheet of glass mounted within said frame;

c. a venetian blind mounted to the frame on the side of the secondary glazing sheet which will face the primary door glazing; and d. holding means adapted to engage said rectangular frame and affix the entire assembly to the surface of the door surrounding the window.

Such a structure is user friendly because it is simple for a user to unscrew and remove one or more of the screws which hold the primary window insert and subsequently re-apply these (or other), screws together with holding means to secure the secondary glazing and venetian blind assembly in place.

The holding means may take a number of different forms. One form involves providing the rectangular frame with screw holes, and the screws which are used to hold the primary window insert fitting are reapplied and engaged in the screw holes of the primary frame. In order to fit such an assembly, however, it will be necessary to remove all of the screws from the primary window insert fitting initially and to subsequently screw them all back in, and this sometimes proves cumbersome. This also requires perfect pre-alignment of the holes in the secondary frame with those of the primary frame, which can be difficult. Therefore, according to a preferred arrangement, the holding means comprise a plurality of clips, each clip being secured to the main door body by a separate one of the screws. With such an arrangement one can remove the screws from the door one at a time and reapply them, together with the clips, to hold the venetian blind assembly in place.

A further embodiment of the present invention, for a glazed door, comprises a venetian blind assembly which includes:

a. a first rectangular frame adapted to be secured on the surface of the door;

b. means affixing said first rectangular frame directly to said door and surrounding the window;

c. a second rectangular frame of substantially the same dimensions as the first frame;

d. a glazing sheet of glass mounted within the second rectangular frame;

e. a venetian blind mounted completely within said second rectangular frame on the door side of the secondary sheet of glass; and f. securing means for securing the second frame to the first frame.

The means of fixing the first rectangular frame directly to the door body again can take a number of different forms. For example, there may be simply further screws which are screwed into a hole subsequently bored in the main door body. Alternatively they may simply be in the form of a double sided adhesive tape adhered to the rear of the first rectangular frame and, when the other release sheet of the double sided adhesive tape is removed, the adhesive tape may be pressed against the main door body around the rectangular window opening. If the door is likely to be subjected to considerable loading, additional screws may then be added firmly to affix the first rectangular frame to the door main body.

Again, the securing means may take a number of different forms but in a preferred structure, they involve a spring clip arrangement.

DESCRIPTION OF THE PREFERRED EMBODIMENTS

Figure 1:
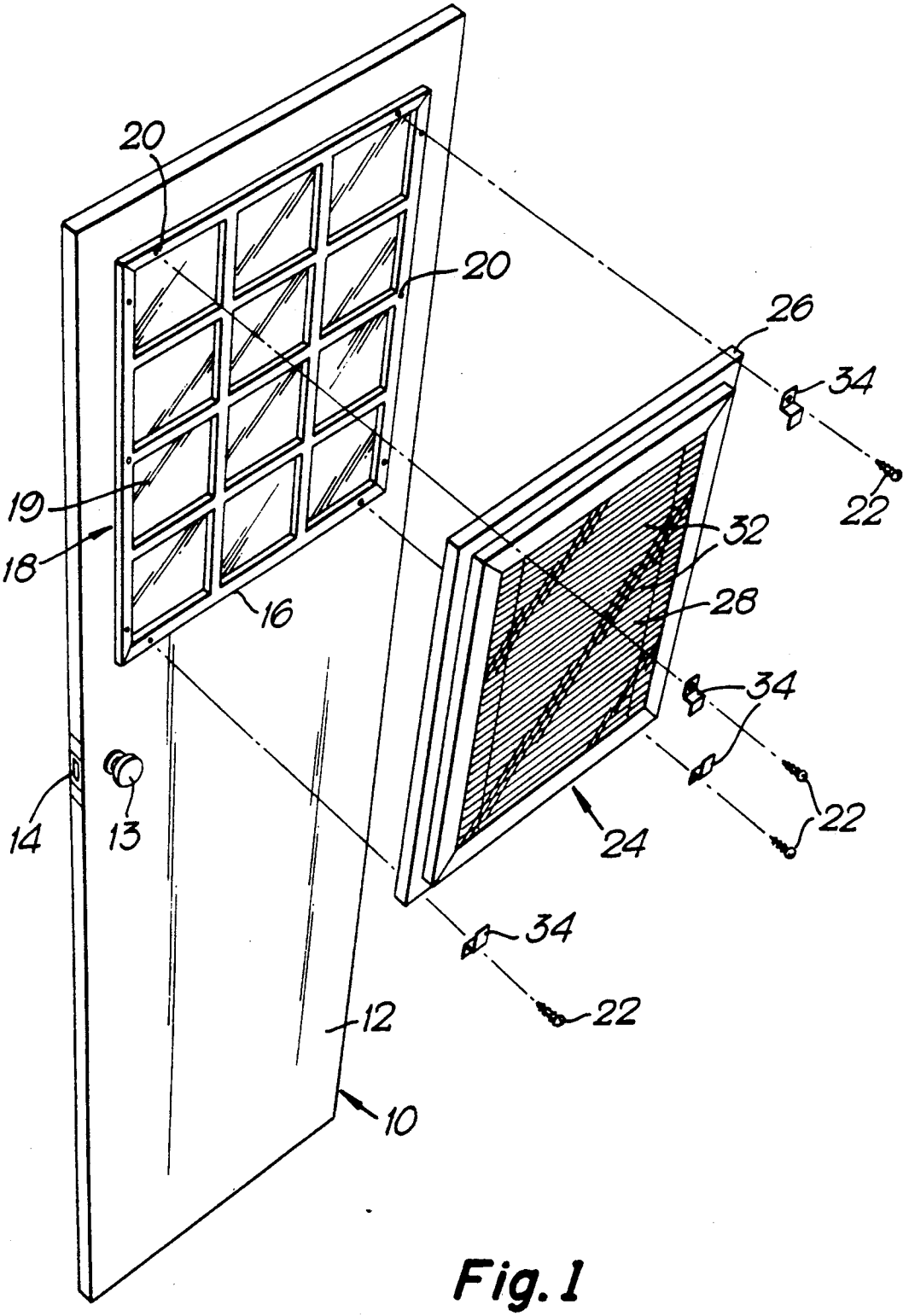
FIG. 1 is an exploded perspective view of a glazed door with one embodiment of venetian blind assembly according to the present invention shown being fitted.

Referring first to FIG. 1, there is illustrated therein a hinged door 10 including a main door body 12 provided with handle and lock 13,14. A rectangular window opening 16 has inserted therein a window insert 18 having A primary glazing 19. Window insert 18 has two halves or panels, one on each side of the door body. The first half or panel of the window insert 18 has screw holes 20 for receiving screws 22 which secure the panel to the door. The other half or panel of insert 18 (not shown) has screw holes (not shown) corresponding to the holes 20 in the first half of window insert 18. The window insert is held in place normally by screws 22 passed through the holes 20 and into the screw holes formed in the outer half of insert 18, thus compressing the door body 12 between the two halves or panels of the window insert 18.

According to the invention there is mounted on this conventional glazed door 10 a venetian blind assembly 24 including a rectangular frame 26 in which is mounted a secondary glazing sheet 28. Wholly within the frame 26 and to the door body side of glazing sheet 28 is mounted a venetian blind the slats of which are shown schematically at 32 in FIGS. 1 and 2.

In order to mount the assembly 24 to the glazed door 10, the screws 22 are removed, preferably one at a time, and these screws are then passed through fixing clips 34 and then through the holes 20 into the screw holes in the outer half insert 18. New screws slightly longer than the original ones may be used.

In the construction illustrated there are twelve screws 22, three on each of the four sides of the rectangular window insert 18; only four of these are required to make the installation.

Figure 2:
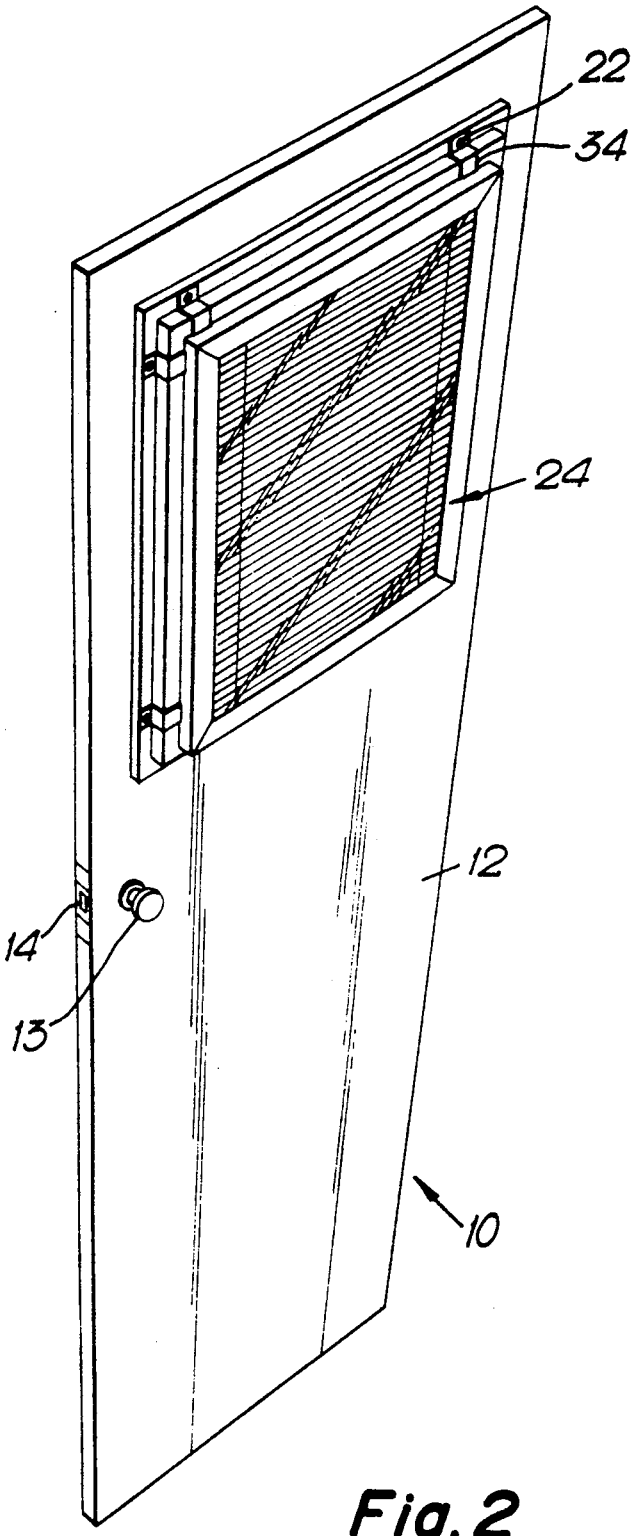
FIG. 2 is a view similar to FIG. 1 but with the venetian blind assembly fitted.

FIG. 2 illustrates the unit 24 held in place in this way. For simplicity of illustration only two clips and their associated screws have been shown.

It will be appreciated that such a structure is extremely easy to fit requiring no special tools, only a screw driver. The venetian blind assembly will be held firmly in place and will not be allowed to flap or sway when the door is opened and shut and will always remain clean being enclosed in the double glazing formed between the primary glass 19 and the secondary glass 28.

Figure 3:
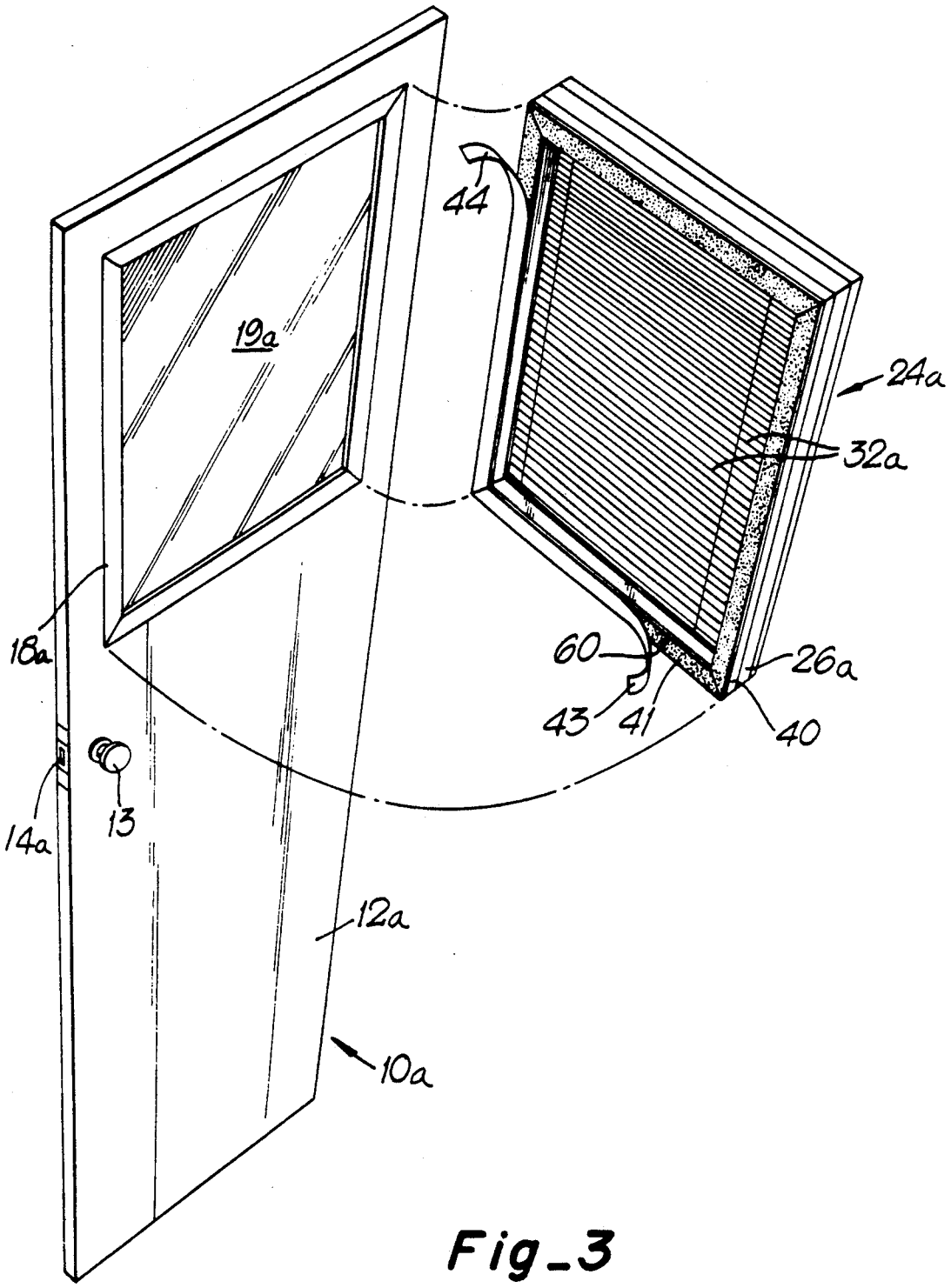
FIG. 3 is an exploded view of a glazed door with a second embodiment of venetian blind assembly according to the present invention.
Figure 4:
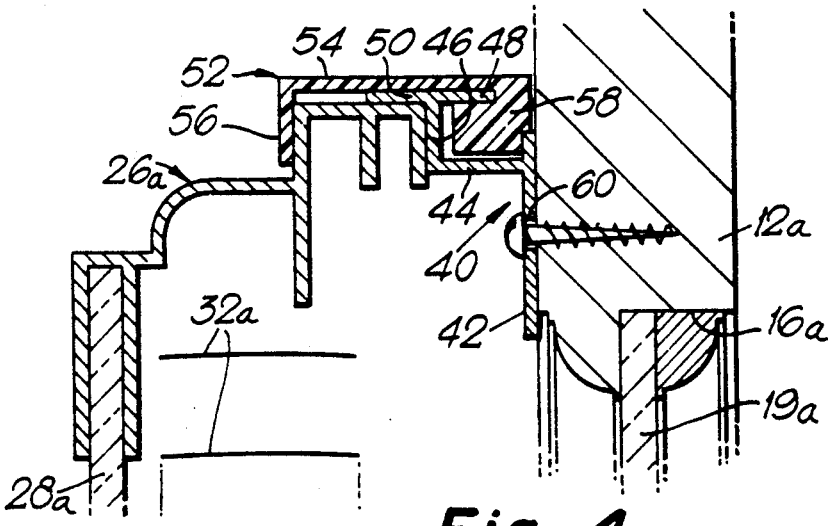
FIG. 4 is an enlarged fragmentary perspective view of a portion of the venetian blind assembly of FIG. 3.
Figure 5:
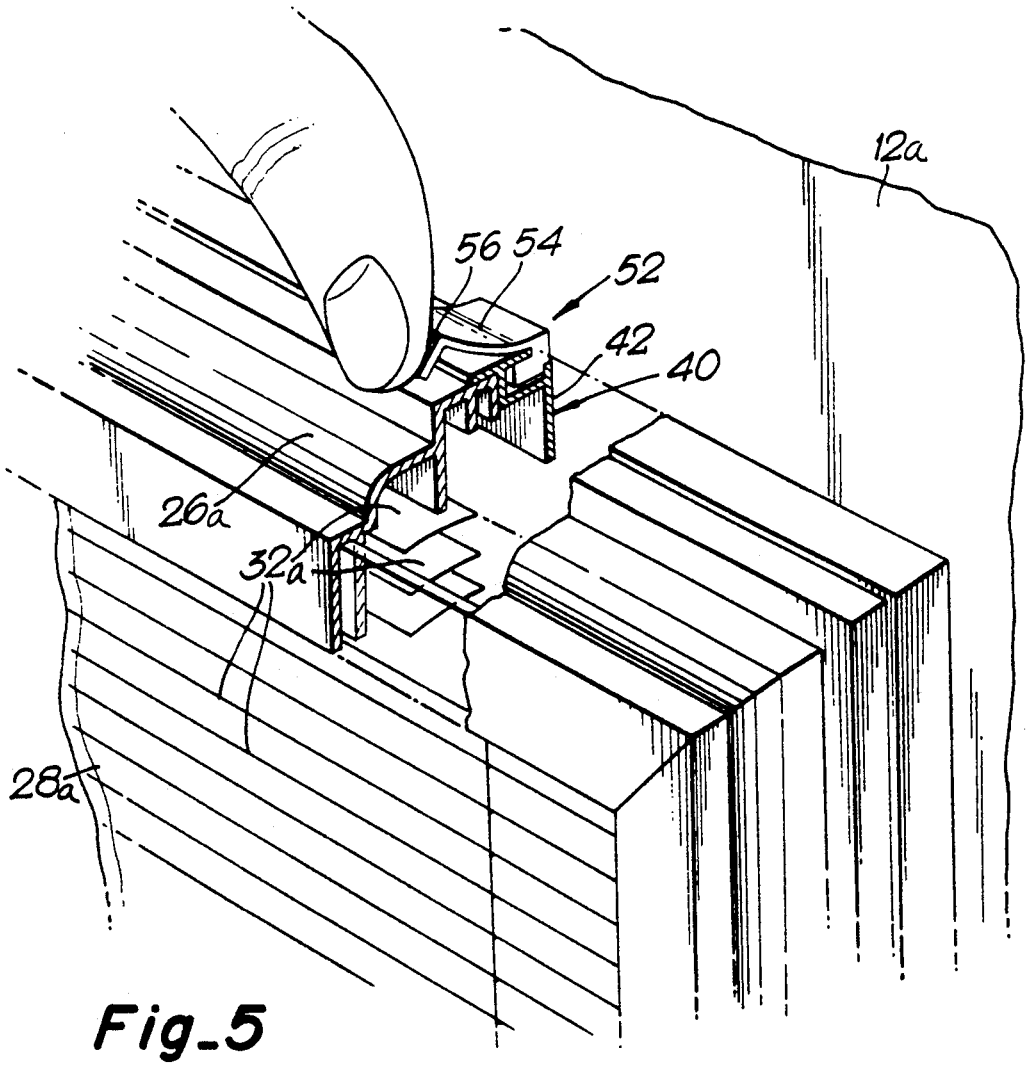
FIG. 5 is an enlarged cross-section of a portion of the assembly of FIGS. 3 and 4.

A modified form of the invention is shown in FIGS. 3, 4, and 5, having particular but not exclusive utility for application to a door which has a somewhat simpler window insert with a single sheet of primary glazing. In describing this modification, reference numerals similar to those used above will be utilized with the distinguishing suffix "a". This modification is shown in use on a door 10*a* having door body 12*a* with a handle 13*a* and latch 14*a*. The door is provided with an opening 16*a* in which is mounted a window insert 18*a*. The window includes a primary glazing 19*a* held in place by appropriate moldings, as shown in FIG. 4.

The venetian blind assembly 24*a* is generally similar to the assembly described above, except that it is formed by a first rectangular frame 40 adapted to receive and support a second rectangular frame 26*a* incorporating a secondary glazing 28*a* and venetian blind with slats 32*a*.

The first rectangular frame 40 has associated with its rear face double sided adhesive tape 41, the release strip 43 of which has been shown to peeled off on two sides of the frame.

If reference is now made to FIG. 5, the first rectangular frame 40 is shown adhered to the main door body 12*a*, this frame being of an extrusion having a back portion 42, a forwardly projecting arm 44 and an outwardly projecting leg 46 having two laterally projecting flanges 48,50.

A clip 52 formed, for example, of a clear plastic material is of a generally channel shape having a web portion 54, a forward arm 56 and a rear arm 58 which is shaped to be a slide fit into the groove formed between the arm 44, the leg 46 and the flange 48. In this way the clip is incorporated with, or integrally formed on the first rectangular frame 40.

Referring to FIG. 5, the unit 24*a* is shown engaged against the first rectangular frame 40 and the forward arm 56 of the clip 52 is shown as being lifted upwardly to allow the unit 24*a* to be positioned in this way. The clip is then released and it takes up the position illustrated in FIG. 4 in which the arm 56 overlies the front of the second frame 26*a*. It will be seen that this frame in fact is positioned within the lateral flange 50 and abuts against the leg 46. The clips 54 will therefore keep the second rectangular frame 26*a* located within the peripheral wall formed by the flange 50. The weight of the venetian blind assembly will thus be borne by the lower part of the first rectangular frame 40, in particular the flange portion 50 of that lower part. The clips on all four sides will retain the venetian blind assembly in place.

As can be seen in FIG. 3, the frame 40 may be provided with further apertures 60, preferably on all four sides, through which screws may be passed for screwing into the door body 12*a* to give further strength for the attachment. These screws may be provided in addition to or in place of the self adhesive tape 41,43.

In some circumstances, for example, with a metal door, holes will need to be drilled to accept the screws. The frame 40 may be used as a template for this purpose, the drill being passed through the apertures 60.

Operation of the venetian blind can be carried out by a slider provided with a magnet cooperating with a follower located within the space between the primary and secondary sheets of glass 19,28. Such an operating arrangement is illustrated in U.S. Pat. No. 4,768,576.

It should be apparent from the foregoing that the structure described is simple to mount and requires only a minimum number and type of tools.

We claim:

1. For use on a glazed door comprising a main door body having a window opening defined therein, and a window insert affixed in said window opening, said window insert including a primary glazing, a venetian blind assembly comprising a first frame, means affixing said first frame to said door body in surrounding relation with said window opening, a second frame dimensioned to fit closely within said first frame, a secondary glazing mounted within said second frame, a venetian blind mounted within said second frame adjacent said secondary glazing, and means for securing said second frame within said first frame to position said venetial blind between said primary glazing and secondary glazing, said securing means comprising a plurality of spring clips of generally channel shape and including a resilient web portion and two parallel arms, said arms engaging respectively said first frame and said second frame to hold said first and second frames in abutting engagement with one another.

2. A venetian blind assembly as claimed in claim 1, wherein aid first frame defines a groove extending therearound, and wherein an arm of each clip is securely engaged in said groove.

3. A venetian blind assembly as claimed in claim 1, wherein said means affixing said first frame to said door body comprise double sided adhesive tape secured to said first frame by one adhesive face of said double sided adhesive tape.

4. A venetian blind assembly as claimed in claim 1, wherein said means affixing said first frame to said door body comprise screw means passing through said first frame and threadably engaging said main door body.

5. A venetian blind assembly as claimed in claim 1, wherein said spring clips are formed integrally with said first frame.

* * * * *